US005829452A

United States Patent [19]

Oster

[11] Patent Number: 5,829,452

[45] Date of Patent: Nov. 3, 1998

[54] HUMIDIFICATION DEVICE

[76] Inventor: Stanley M. Oster, 2707 Gateway Dr., Pompano Beach, Fla. 33069-4323

[21] Appl. No.: 898,671

[22] Filed: Jul. 22, 1997

[51] Int. Cl.[6] ..... A24F 13/24

[52] U.S. Cl. ..... 131/250; 131/328; 131/329; 312/31

[58] Field of Search ..... 260/29.6; 131/329, 131/328, 250; 312/31, 231

[56] References Cited

U.S. PATENT DOCUMENTS

| | | | |
|---|---|---|---|
| 1,481,325 | 1/1924 | Gris | 131/329 |
| 3,980,663 | 9/1976 | Gross | 260/29.6 |

FOREIGN PATENT DOCUMENTS

| | | | |
|---|---|---|---|
| 635981 | 11/1989 | Australia | 260/29.6 |

*Primary Examiner*—John G. Weiss
*Assistant Examiner*—Charles W. Anderson
*Attorney, Agent, or Firm*—Malin, Haley, DiMaggio & Crosby, P.A.

[57] ABSTRACT

A container, which may or may not be in the form of a cylinder conforming generally to the shape of a cigar, having a wall thickness and constitution which permits water vapor to escape therethrough, but which will not permit water droplets or palpable moisture to pass therethrough and subsequently over-wet the material to be humidified, such as cigars. The container is adapted to house a quantity of highly absorbent material, such as acrylamide potassium or sodium acrylate copolymer, cross-linked. End caps may be used as desired, including end caps with apertures therein to permit an accelerated rate of humidification by allowing more water vapor to escape the interior of the container than is allowed by ordinary osmosis through the walls of the container.

25 Claims, 4 Drawing Sheets

HUMIDIFICATION DEVICE

BACKGROUND OF THE INVENTION

1. Field of the Invention

This invention relates generally to the art of humidification, and more particularly relates to a device which maintains the humidity level in a relatively confined environment, such as a cigar box or humidor, within a desired range.

2. Description of the Background Art

It is well known that the optimum range of relative humidity at which tobacco products such as cigars should be stored to optimize freshness is above 67% to minimize drying of the tobacco and below 75% to inhibit the growth of mold and mildew, with 70% being ideal. Numerous efforts have been directed toward achieving this level of humidity in confined environments, such as humidors. Perhaps the most widespread devices consist of a slotted container containing moisture absorbing material inside, in one case a ceramic block, or in another case open-cell foam commonly referred to as "oasis" material which is commonly used to hold and hydrate flower stems. In both cases, regular re-hydration is required by either manually removing the material and pouring distilled water over it or adding water to it while it is in the humidor. In either case, the risk of dripping water on the cigars in the humidor is unnecessarily present. Furthermore, it is necessary to rehydrate these types of materials more frequently than many cigar enthusiasts actually do, and users of these devices cannot tell when the hydrating materials have dried and need additional water, which makes necessary the use of an expensive gauge.

Moreover, it has become common to add propylene glycol to the water poured into the oasis material to help control the evaporation of the water therein and help stabilize a 70% relative humidity. Propylene glycol is a hydrostatic liquid which absorbs moisture when the relative humidity goes over 70% and allows evaporation of water when the relative humidity drops below 70%. Prior art devices which utilize propylene glycol do not maintain the proper ratio of water to propylene glycol within the humidification device because the propylene glycol content in the device is washed out during the rehydration process. That is, when water is poured into such devices having open cell foam impregnated or partially saturated with propylene glycol, if any water drips or runs out, it carries with it some of the remaining propylene glycol. After this happens repeatedly, as it commonly does during the refilling process, the propylene glycol is either totally removed by rinsing action or is so depleted that it no longer functions to stabilize the local relative humidity.

Also, glycerin-based liquids have been used in place of propylene glycol, which suffers from the aforementioned disadvantages when used with prior art devices, e.g., open-cell foam. In addition, glycerin lacks the anti-bacterial properties of propylene glycol.

Still further, when reusing the ceramic block or oasis material for an extended duration, the pores of the material become clogged with potentially dangerous organic growths such as mold, spores, and mildew, adding a potential health risk, even if propylene glycol is used.

Efforts at providing humidification devices in the form of self-contained dispensing receptacles are also to be found. One example is disclosed in U.S. Pat. No. 3,431,038 to Berliner, which utilizes a tubular, nonporous, housing defining a water reservoir in fluid communication with a chamber of tightly packed, water-absorbent, material. A series of peripheral openings surrounding the water-absorbent material provides communication between the water in the water-absorbent material and the interior of the humidor. This invention presents the obvious drawback of leaking or dripping of water if the water-absorbent material becomes too heavily saturated or the device is laid on its side or suspended upside down and over-humidification (great than 75%) can occur.

Another effort is seen in U.S. Pat. No. 4,428,892 to Berliner, which discloses a humidifier device adapted to be placed in the carrying case of stringed or other musical instruments subject to modification by reason of lack of moisture. This device is a complicated, multi-chambered, apparatus which also requires refilling of a reservoir with water. Another humidifier device is disclosed in U.S. Pat. No. 5,289,751 to Light. The device disclosed in the Light patent is a humidifier for wooden musical instruments comprising a stiff tubular member having a plurality of holes of about 0.10 inch in diameter disposed therein, a water-absorbent material such as cellulose, and a cap. It is specifically noted in the Light patent that the tubular member is not capable of holding water by itself because of the relatively large diameter holes, hence the use of cellulose.

Finally, U.S. Pat. No. 5,556,579 to Newman discloses a tobacco jar cover having humidity control, comprising a lid mountable to a receptacle for tobacco or other perishable item and a humidistat comprised of a cylindrical body for containing water and an absorbent material, and a number of passages or orifi defined by the container for allowing water vapor to pass therethrough and thereby elevate the humidity level within the receptacle. This structure also suffers from the drawback of having large apertures through which drops of water can pass and come into contact with the material to be humidified.

Therefore, a need is seen for a humidity control device that is self-contained, does not allow drops of water to pass therethrough, and is simple and inexpensive to manufacture and use.

SUMMARY OF THE INVENTION

Accordingly, the primary object of the present invention is to provide a humidification device which is simple of construction, will not wet the material to be humidified beyond exposure to a predetermined humidity level, and can fit within a conventional cigar box or humidor next to a cigar.

Another primary object of this invention is to provide a humidification device for cigars or other materials whereby the user can easily tell when it is necessary to add additional water.

Another primary object of this invention is to provide a humidification device whereby the user can add water to the device without diluting the content of the propylene glycol contained therein.

Another object of this invention is to provide a humidification device for cigars and other materials which require humidification for the maintenance thereof which is easy to handle and provides a clean and pleasant appearance.

The foregoing objects are accomplished by providing an elongated container, which may or may not be in the form of a cylinder conforming generally to the shape of a cigar, having a wall thickness and constitution which permits water vapor to escape therethrough, but which will not permit liquid or palpable moisture to pass therethrough and subsequently over-wet the material to be humidified, such as cigars. The container is adapted to house a quantity of highly absorbent material, such as acrylamide potassium or sodium acrylate copolymer, cross-linked, sold under the trademark Stockosorb™ by Stockhausen, Inc. of Greensboro, N.C. One pound of Stockosorb™ can absorb approximately 25 gallons of water, and is completely nontoxic, insoluble, has no odor, and does not drip. The material is suitable for normal wastewater treatment and for approved solid waste landfill disposal. A suitable substitute is a super absorbent polyacrolate sold under the trademark Aquatain 2–4 MM® sold by Aquatain, Inc. of Lakeland, Fla. This material functions in essentially the same manner as Stockosorb™. Both products are provided in granular form and swell upon the absorption of liquids such as water. Therefore, a small amount of the granular material placed within the container and mixed with water and propylene glycol will create a full container of fully saturated material that does not drip. As the water evaporates from the swollen crystals, they become smaller, thereby giving a visual indication of when additional water should be added. End caps may be used as desired, including end caps with apertures therein to permit an accelerated rate of humidification by allowing more water vapor to escape from the interior of the container than is allowed by ordinary osmosis through the walls of the container.

The container is preferably a propionate material manufactured by Flex Products of Carlstadt, N.J., having a wall thickness in the range of 0.010 to 0.020 inch.

The invention can be made in various shapes and can be put to various uses, including being connectable to a humidor and the surface area of the container exposed to the interior of the humidor can be varied by mechanical means.

In accordance with these and other objects which will become apparent hereinafter, the instant invention will now be described with particular reference to the accompanying drawings.

DESCRIPTION OF THE PREFERRED EMBODIMENTS

Figure 1A:
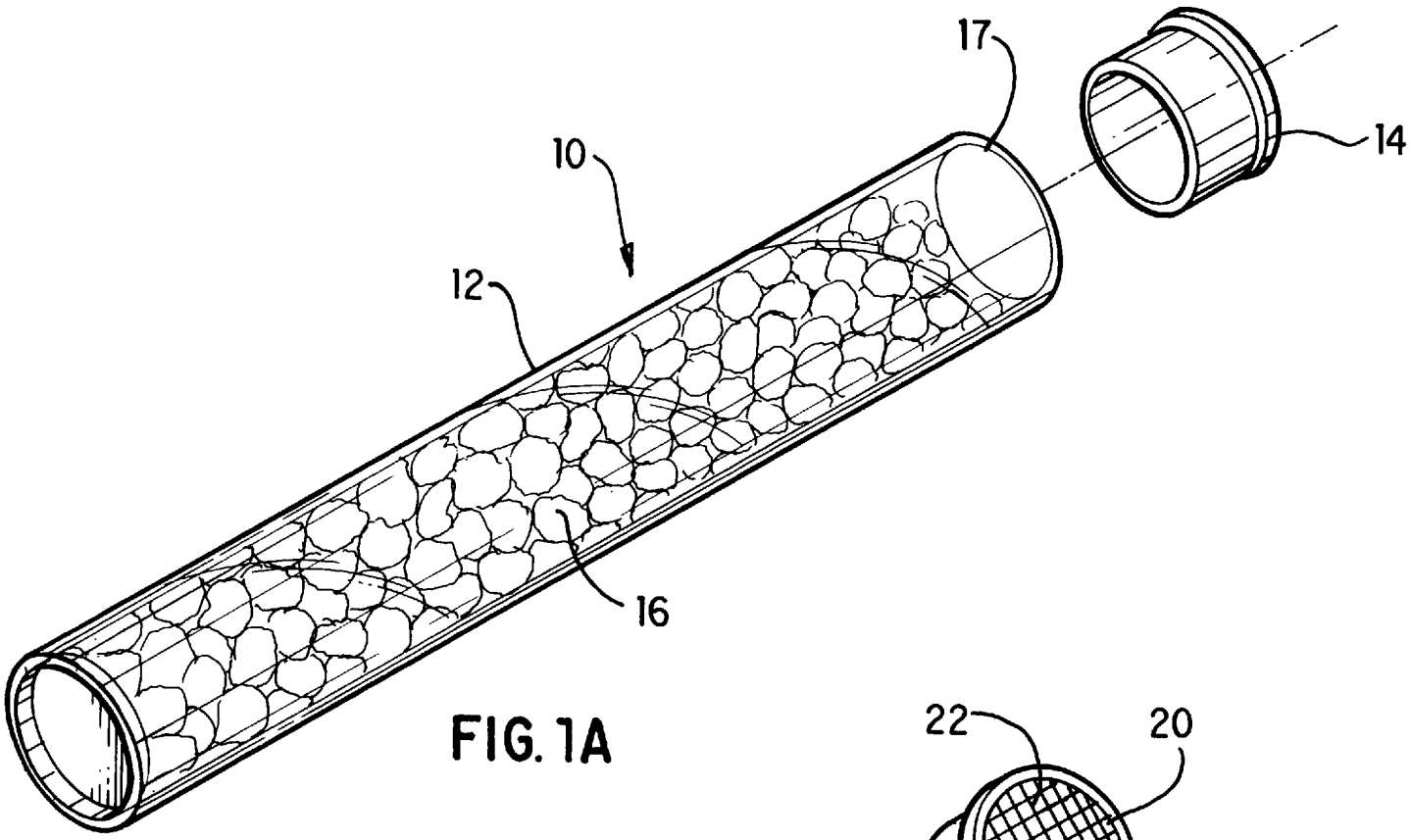
FIG. 1*a* is a perspective, partially exploded, view of a first embodiment of my invention.

Referring now to FIG. 1*a*, my humidification device 10 in its simplest form is comprised of an elongated container 12, which may or may not be cylindrical in shape, and which may or may not conform to the dimensions of certain cigar sizes, adapted to house a quantity of super-absorbent material such as acrylamide potassium or sodium acrylate copolymer, cross-linked, sold under the trademark Stockosorb™ by Stockhausen, Inc. of Greensboro, N.C. The container is preferably closed at one end and is provided with a removable closure element such as cap 14 at the other, which is adapted to be placed in substantially sealing engagement about end opening 18 defined by container 12.

The super-absorbent material 16 is activated by pouring an aqueous solution, e.g., water or a water/propylene glycol mix, into container 12, which hydrates the material 16 in such a way that material 16 absorbs the solution and by doing so becomes substantially gelatinous, preferably filling substantially the entirety of the interior of container 12. The super-absorbent material does not drip or give off palpable moisture except through evaporation.

Container 12 is comprised, at least in part, of a material which is preferably transparent and which is pervious to water vapor but not liquid. The wall thickness of the material of container 12 should be such that, together with the pore sizes thereof, water vapor resulting from the evaporation of water held by material 16 will pass therethrough at a rate which will maintain the desired humidity level within the enclosure. The rate of humidification will depend upon the wall thickness of the container, the amount of surface area of the sidewalls of container 12 which will allow water vapor,to pass through, as well as the volume of the aqueous solution within the container.

The material of which container 12 is manufactured, as stated above, should be porous or permeable to water vapor, but not to water in its liquid phase. One suitable material has been found to be propionate, having a wall thickness in the range of 0.015 inches, manufactured by Eastman Chemical Company of Kingsport, Tenn., under the trademark Tenite™.

Figure 1B:
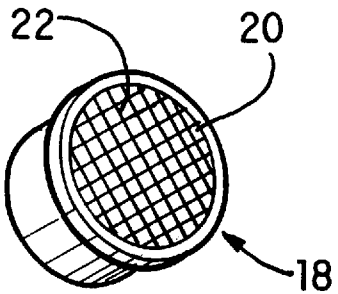
FIG. 1*b* is a perspective, partially exploded, view of a second embodiment of my invention.

Referring now to FIG. 1*b*, an alternative end cap 18 is shown which can be utilized in place of cap 14 of FIG. 1*a* where a higher rate of humidification is desired, such as where the material to be humidified is dried out. Cap 18 defines an opening 20, which may be covered by a screen or mesh 22 or perforated to prevent material 16 from exiting therethrough.

Either embodiment shown in FIGS. 1*a* and 1*b* may be simply placed within a cigar box or humidor, or other environment wherein humidity enhancement is desired. It has been determined that a container 12 having a circumference corresponding to a cigar in the range of 40 to 64 ring size and having a length of 4.5 to 10 inches, upon saturating the super-absorbent material 16 with the aqueous solution, will maintain the humidity level in the desired range within a standard sized cigar humidor for over two months without the need to refill. This period is substantially longer than the period of time in which adequate humidification is provided by standard ceramic block or open-cell foam humidifiers, which need recharging every two to six weeks.

Figure 2A:
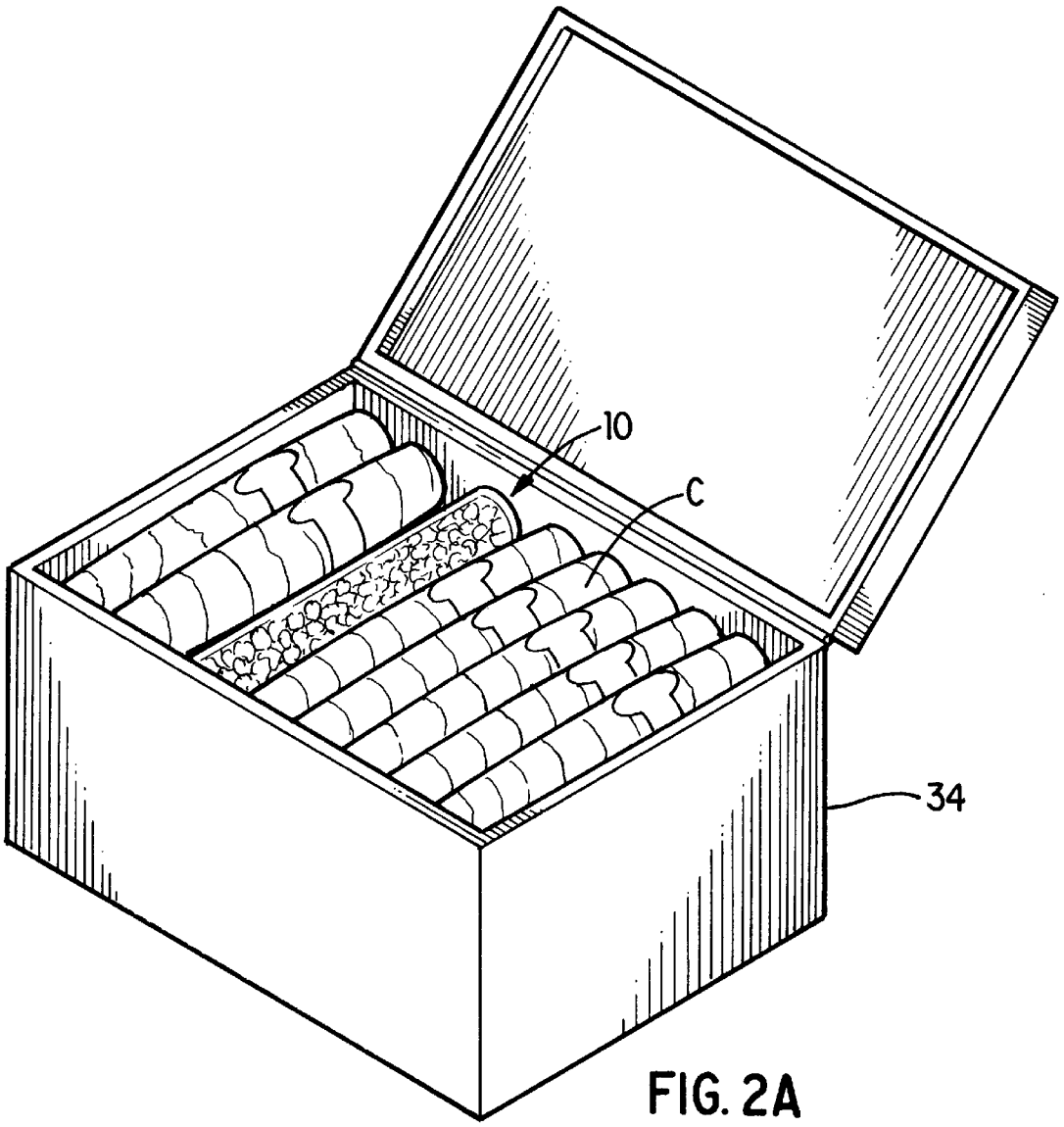
FIG. 2 is a perspective view of a humidor showing one application of my invention thereto.
Figure 2B:
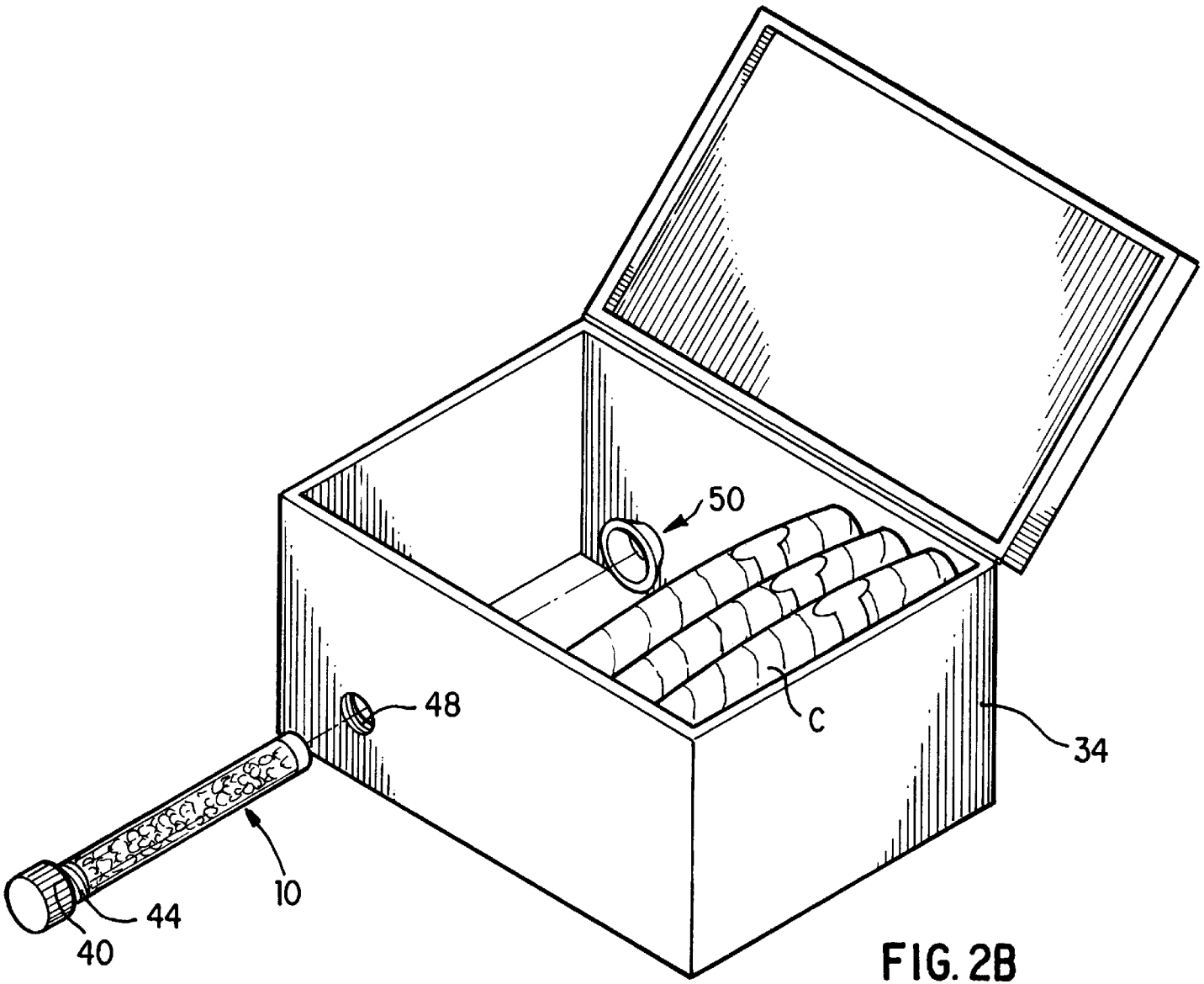
Figure 3:
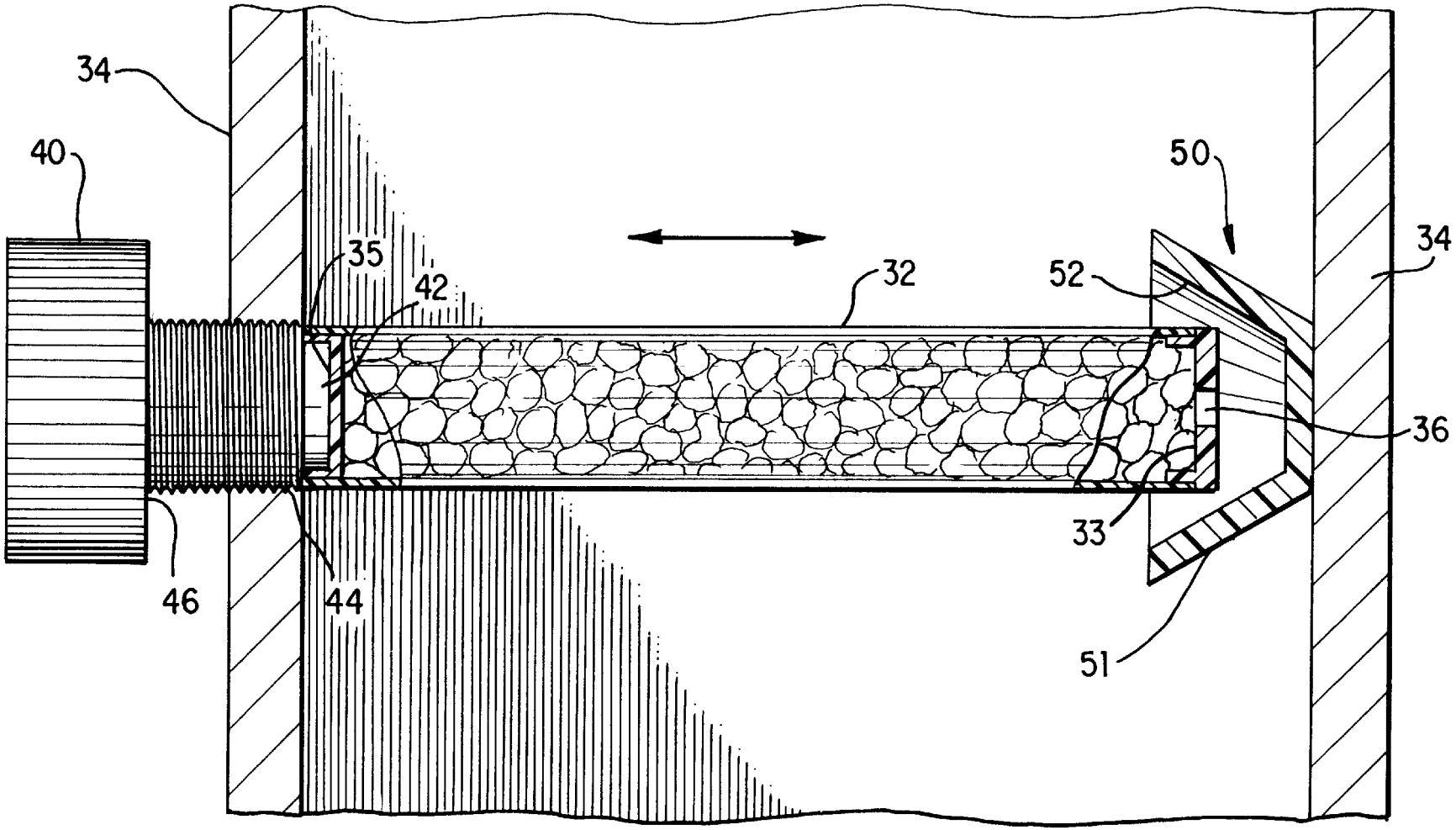
FIG. 3 is a cross-sectional view of the application of my invention shown in FIG. 2, taken along lines 3—3.

Referring now to FIGS. 2 and 3, there is disclosed an alternate application of my invention in the form of a container 32 made of substantially the same material as that of container 12, adjustably connected within a cigar humidor 34. An integral end cap 33 is utilized to seal container 32 at the right side thereof in FIG. 3. End cap 33 defines an aperture or apertures 36 therein which permits, if desired, enhanced humidification in the same manner as cap 18 of FIG. 1*b*. Container 32 is sealed at its open end, seen to the left in FIG. 3, by an adjustment cap 40 having a plug end 42 adapted to be sealingly received within the end 35 of container 32. Cap 40 is threadingly received within a correspondingly threaded aperture 48 of side wall 34 of the humidor H via threads 44. A sealing structure such as gasket or O-ring 46 may be utilized at the interface of cap 40 and humidor side wall 34. The opposite end of container 32, at end cap 33, is received within a generally frustro-conical socket 50 defining a tapering inner surface 52 against which end cap 33 mates when end cap 40 is threaded as far to the right as it will go in FIG. 3. Rotating cap 40 causes container 32 to be translated to the left or right in FIG. 3, depending upon the direction of rotation thereof. The further to the left container 32 is moved in FIG. 3, the larger is the opening between cap 33/container 32 and inner surface 52 of socket 50. The larger that opening, the greater the rate of evaporative mass transfer from the interior of container 32 to the inner volume of humidor H. Alternatively, if container 32 is translated as far to the right in FIG. 3 as it can go, and 33 will abut surface 52 and interrupt fluid communication between the interior of container 32 and the interior of humidor H via aperture 36. In this case, evaporative mass transfer of water vapor will still occur through the walls of container 32. By providing the adjustable feature of FIGS. 2–3, normal humidification can be attained when ultra-humidification is not needed, and vice versa.

The aqueous liquid which is combined with absorbent material 16 may be modified with a fragrant or colored substance as desired to alter the flavor of the material being humidified and/or to create a favorable aesthetic appearance of the humidification device itself, respectively. The solution utilized with this invention does not necessarily have to include tap water, distilled water, or propylene glycol. It has been found that a mixture of propylene glycol and tap or distilled water is preferred.

One of the primary advantages of utilizing a transparent material in the side walls of the container 12 is that a visual indication is given of when water must be added to the container. The prior art devices, both the ceramic block and open-cell foam types, do not provide any visual indication whatsoever and, therefore, require the use of a hydrometer. By utilizing the invention described herein, the expense of purchasing a hydrometer is done away with.

Also, by utilizing a container which is essentially impervious to liquid, any propylene glycol held within the container is not rinsed away when water is added, as frequently happens with the open-cell type devices seen in prior attempts at humidification.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A device for humidifying an enclosed volume, comprising:

a container having at least a portion thereof which is pervious to water vapor but not liquid; and a quantity of a material disposed within said container which is capable of absorbing and retaining a predetermined quantity of water, said material changing between a granular consistency when dry to a semi-gelatinous consistency when said predetermined quantity of water is absorbed therein, and which is also capable of giving up said water by way of evaporation through a wall of said container.

2. The humidification device of claim 1, wherein said material capable of absorbing and retaining water is selected from the group consisting of acrylamide potassium acrylate copolymer, cross-linked.

3. The humidification device of claim 1, wherein said portion of said container pervious to water vapor but not liquid is comprised of propionate.

4. The humidification device of claim 1, wherein said container is in the form of an elongated cylinder between 1 and 10 inches in length and between ½ inch and 3 inches in diameter.

5. The humidification device of claim 4, wherein said container defines an open end, and further comprising a closure element adapted to be removably placed over said opening.

6. The humidification device of claim 5, wherein said closure element defines an aperture which is pervious to liquid.

7. The humidification device of claim 6, further comprising a means for partially closing said aperture.

8. The humidification device of claim 7, wherein said means for partially closing is a mesh screen material.

9. A method of humidifying an enclosed volume, comprising:

providing an enclosed volume;

providing a humidification device comprising:

a container having at least a portion thereof which is pervious to water vapor but not to liquid; and a quantity of a material disposed within said container which is capable of absorbing and retaining a predetermined quantity of water, said material changing between a granular consistency when dry to a semi-gelatinous consistency when said predetermined quantity of water is absorbed therein, and which is also capable of giving up said water by way of evaporation through a wall of said container; and placing said humidification device within said volume.

10. A method of humidifying an enclosed volume according to claim 9, wherein said material capable of absorbing and retaining water is selected from the group consisting of acrylamide potassium acrylate copolymer, cross-linked.

11. A method of humidifying an enclosed volume according to claim 9, wherein said portion of said container pervious to water vapor but not liquid is comprised of propionate.

12. A method of humidifying an enclosed volume according to claim 9, wherein said container is in the form of an elongated cylinder between 1 and 10 inches in length and between ½ inch and 3 inches in diameter.

13. A method of humidifying an enclosed volume according to claim 12, wherein said container defines an open end, and further comprising a closure element adapted to be removably placed over said opening.

14. A method of humidifying an enclosed volume according to claim 13, wherein said closure element defines an aperture which is pervious to liquid.

15. A method of humidifying an enclosed volume according to claim 14, further comprising a means for partially closing said aperture.

16. A method of humidifying an enclosed volume according to claim 15, wherein said means for partially closing is a mesh screen material.

17. A system for humidifying tobacco products, comprising:

a humidor for receiving tobacco products;

a humidification device comprising:

a container having at least a portion thereof which is pervious to water vapor but not to liquid; and a quantity of a material disposed within said container which is capable of absorbing and retaining a predetermined quantity of water, said material changing between a granular consistency when dry to a semi-gelatinous consistency when said predetermined quantity of water is absorbed therein, and which is also capable of giving up said water by way of evaporation through a wall of said container; and, wherein said humidification device is at least partially disposed in said humidor.

18. A system for humidifying tobacco products, according to claim 17, wherein said material capable of absorbing and retaining water is selected from the group consisting of acrylamide potassium acrylate copolymer, cross-linked.

19. A system for humidifying tobacco products, according to claim 17, wherein said portion of said container pervious to water vapor but not liquid is comprised of propionate.

20. A system for humidifying tobacco products, according to claim 17, wherein said container is in the form of an elongated cylinder between 1 and 10 inches in length and between ½ inch and 3 inches in diameter.

21. A system for humidifying tobacco products, according to claim 20, wherein said container defines an open end, and further comprising a closure element adapted to be removably placed over said opening.

22. A system for humidifying tobacco products, according to claim 21, wherein said closure element defines an aperture which is pervious to liquid.

23. A system for humidifying tobacco products, according to claim 22, further comprising a means for partially closing said aperture.

24. A system for humidifying tobacco products, according to claim 23, wherein said means for partially closing is a mesh screen material.

25. An apparatus for humidifying tobacco products, comprising:

a container for housing a supply of aqueous material in semi-gelatinous form, said container having a first end and a second end;

said first end of said container defining a first opening for installing said supply of aqueous material into said container;

a means for sealing said first opening and for moving the container relative to a housing defining a humidifiable volume; and means, within said housing, for receiving said second end of said container;

wherein said container has at least one side wall portion which is pervious to water vapor but not to water in liquid state.

* * * * *